US005112708A

United States Patent [19]

Okunuki et al.

[11] Patent Number: 5,112,708

[45] Date of Patent: May 12, 1992

[54] MEMBER FOR CHARGING WITH SURFACE LAYER OF N-ALKOXYMETHYLATED NYLON EFFECTING CHARGING AT LOWER VOLTAGE

[75] Inventors: Masami Okunuki, Tokyo; Hisami Tanaka, Yokohama; Hiroyuki Ohmori, Tokyo; Masafumi Hisamura, Kawasaki, all of Japan

[73] Assignee: Canon Kabushiki Kaisha, Tokyo, Japan

[21] Appl. No.: 696,977

[22] Filed: May 2, 1991

Related U.S. Application Data

[63] Continuation of Ser. No. 306,993, Feb. 7, 1989, abandoned.

[30] Foreign Application Priority Data

Feb. 11, 1988 [JP] Japan ..... 63-29774

[51] Int. Cl.[5] ..... G03G 13/02

[52] U.S. Cl. ..... 430/31; 430/902; 361/225

[58] Field of Search ..... 430/57, 58, 66, 67, 430/902; 361/225

[56] References Cited

U.S. PATENT DOCUMENTS 3,697,836 10/1972 Moss et al. ..... 317/262 A
4,248,518 2/1981 Nishikawa ..... 430/902
4,663,259 5/1987 Fujimura et al. ..... 430/58
4,835,079 5/1989 Fujimura et al. ..... 430/58

FOREIGN PATENT DOCUMENTS 0272072 6/1988 European Pat. Off. .
0308185 3/1989 European Pat. Off. .

OTHER PUBLICATIONS

Patent Abstracts of Japan, vol. 7, No. 262 (P-238) (1407).
Patent Abstracts of Japan, vol. 12, No. 19 (P-657) (2866).
Patent Abstracts of Japan, vol. 12, No. 19 (P-547) (2866).

*Primary Examiner*—John Goodrow
*Attorney, Agent, or Firm*—Fitzpatrick, Cella, Harper & Scinto

[57] ABSTRACT

A member for charging comprises a surface layer formed of a N-alkoxymethylated nylon. A contact charging method performs charging of a member to be charged arranged in contact with the member for charging by applying externally a voltage on the member for charging. An electrophotographic device comprises the member for charging and an electrophotographic photosensitive member arranged in contact with the member for charging.

16 Claims, 2 Drawing Sheets

MEMBER FOR CHARGING WITH SURFACE LAYER OF N-ALKOXYMETHYLATED NYLON EFFECTING CHARGING AT LOWER VOLTAGE

This application is a continuation of application Ser. No. 07/306,993 filed Feb. 7, 1989, now abandoned.

BACKGROUND OF THE INVENTION

1. Field of the Invention

This invention relates to a member for charging having improved charging ability, particularly to a member for charging having improved environmental stability and giving no deleterious influence to the surface of a member to be charged.

2. Related Background Art

Heretofore, as the photoconductive material to be used in electrophotographic photosensitive member, inorganic photoconductive materials such as selenium, cadmium sulfide, zinc oxide, etc. have been known. These photoconductive materials have a number of advantages such as charging to an appropriate potential in dark place, little dissipation of charges in dark place, or rapid dissipation of charges by photoirradiation, etc, while having also on the other hand various disadvantages.

On the other hand, it has been discovered that specific organic compounds have photoconductivity. For example, organic photoconductive polymers such as poly-N-vinylcarbazole, polyvinylanthracene, etc., low molecular weight organic photoconductive materials such as carbazole, anthracene, pyrazoline, oxadiazole, hydrazone, polyarylalkane, etc., and otherwise organic pigment or dyes such as phthalocyanine pigments, azo pigments, cyanine dyes, polycyclic quinone pigments, perylene pigments, indigo dyes, thioindigo dyes or squaric acid methine dyes, etc. have been known. Particularly, since organic photoconductive materials such as organic pigments or dyes having photoconductivity can be synthesised more easily as compared with inorganic materials, and yet variation in selection of compounds exhibiting photoconductivity in appropriate wavelength region is expanded, a large number of such materials have been proposed. For example, as disclosed in U.S. Pat. Nos. 4,123,270, 4,251,613, 4,251,614, 4,256,821, 4,260,672, 4,268,596, 4,278,747, 4,293,628, etc., electrophotographic photosensitive members by use of disazopigments exhibiting photoconductivity as the charge generation substance in the photosensitive layer having functions separated into the charge generation layer and the charge transport layer have been known.

The charging process in the electrophotographic process by use of such electrophotographic photosensitive member mostly applies high voltage (DC 5–8 kV) on a metal wire to effect charging by the corona generated. However, according to such method, the surface of the photosensitive member is denatured by corona products such as ozone, NOx, etc. during corona generation, whereby image ambiguity or deterioration may be progressed, or contamination of the wire may affect the image quality, thus involving such problems as generation of image white drop-out or black streaks. Particularly, an electrophotographic photosensitive member having a photosensitive member containing an organic photoconductive material has chemical reactivity because the organic photoconductive material is an organic compound, and is susceptible to deterioration by the corona products.

On the other hand, also as the power source, the current directed toward the photosensitive member was only about 5 to 30% thereof, with most of it flowing to the shielding plate, thus being poor in efficiency as the charging means.

For compensating for such drawbacks, there have been investigated the method of direct charging by contacting a member for charging with a member to be charged such as photosensitive member as disclosed in Japanese Laid-open Patent Publications Nos. 57-178267, 56-104351, 58-40566, 58-139156, 58-150975.

In the prior art, as the member for charging to be used for direct charging, an electroconductive rubber roller having electroconductive particles such as carbon dispersed in a metal core material, or a roller coated with nylon or polyurethane as disclosed in Japanese Patent Publication No. 50-13661 have been known.

However, the electroconductive roller having electroconductive particles dispersed therein of the former is required to increase the amount of the electroconductive particles in order to retain its low resistivity, whereby the rubber hardness is increased, and further due to the hardness of the electroconductive particles dispersed on the surface, there has been the problem that the surface of the member to be charge is damaged. Particularly, in the case when the member to be charged is an electrophotographic photosensitive member having a photosensitive layer containing an organic photoconductive material, its surface hardness is extremely lower as compared with other photosensitive members, and therefore it is susceptible to damage with such electroconductive roller, whereby image defects such as streaks caused by such damage will occur. Further, there has been also involved the problem that no uniform charging can be effected due to irregularity, variance of the electroconductive particles dispersed in the electroconductive rubber roller.

On the other hand, in the case of a roller coated with nylon or polyurethane of the latter, its electrical resistance is greatly affected by the change in use environment, particularly by the change in humidity in the air. For example, under low temperature and low humidity, there has been the problem with respect to environmental stability that its volume resistivity is increased by 3 ciphers. If the member for charging is increased in resistivity, the charging ability will be lowered to effect no uniform charging, and the image density will be lowered when image formation is effected, or in the reversal developing method, black dot images in species corresponding to charging irregularity (black spots) may be formed, while in the normal developing system white dot images (white spots) may be formed, whereby no image of high quality can be obtained in either case. Particularly in the case of nylon, there is also the problem that the photosensitive member is susceptible to damage due to its hardness.

SUMMARY OF THE INVENTION

An object of the present invention is to provide a member for charging which gives no influence such as damage to the surface of a member to be charged, and yet is excellent in environmental stability.

Another object of the present invention is to provide a member for charging which can effect uniform charging without charging irregularity and can obtain good images.

Still another object of the present invention is to provide a member for charging which can effect charging at a relatively lower voltage.

The present inventors have investigated in order to accomplish the above objects, and consequently found that the above objects can be accomplished by use of a specific resin for the surface layer of the member for charging.

Therefore, according to the present invention, there is provided a member for charging, having a surface layer formed of a N-alkoxymethylated nylon.

Also, according to the present invention, there is provided a contact charging method which applies a voltage eternally on the above member for charging to effect charging onto a member to be charged arranged in contact with said member for charging.

Further, according to the present invention, there is provided an electrophotographic photosensitive member having said member for charging and an electrophotographic photosensitive member arranged in contact with said member for charging.

DETAILED DESCRIPTION OF THE INVENTION

Figure 1:
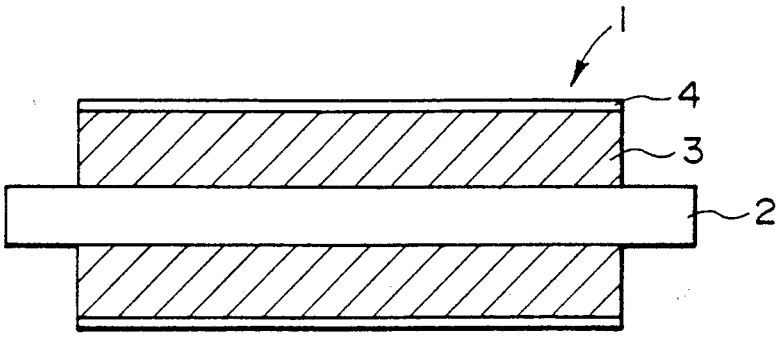
FIG. 1 is a sectional view of the member of charging of the present invention.

The present invention is described below in detail.

The N-alkoxymethylated nylon which forms the surface layer of the member for charging of the present invention is a nylon of which hydrogen atom of the amide bond —NHCO— is substituted with an alkoxymethyl group such as methoxymethyl group, ethoxyethyl group, propoxymethyl group or the like, and is soluble in methyl alcohol, ethyl alcohol or isopropyl alcohol, having particularly high solubility in lower alcohols. When soluble in alcohols, an alcohol can be used as the solvent and therefore the surface layer can be formed without dissolving the subbing layer such as rubber.

For the synthesis of N-alkoxymethylated nylon, for example, 50 g of a nylon-6 resin is dissolved in a solvent mixture of 250 g of formic acid and 250 g of acetic anhydride under stirring. To the resultant solution are added 15 g of p-formaldehyde and 15 g of methanol, followed by heating to 60° C. to carry out the reaction for 5 hours. Next, the reaction mixture is cooled to room temperature, poured into 5 liters of acetone to be precipitated, followed by precipitation to obtain a white reaction product. The product is washed with stirring in a large amount of water, and after filtration, dried under reduced pressure under the conditions of 40° C., 10 to 20 mm Hg, whereby 54.1 g of a N-methoxymethylated nylon 6 (methoxymethyl group substitution degree: 30.6%) can be obtained.

The surface layer of the member for charging in the present invention can incorporate other resins, for example, polyamide resins such as those having nylon 6, nylon 66, nylon 610, nylon 11, nylon 12, etc. copolymerized therein, particularly preferably an alcohol soluble copolymerized nylon such as nylon 6/66/bis(4-aminocyclohexyl)methane 6 copolymer, within the range which does not impair the function such as resistance, environmental stability, hardness, etc.

The member for charging having the surface layer formed of an alkoxymethylated nylon as in the present invention can effect charging of a member to be charged arranged in contact with the member for charging without damaging on behalf of the surface layer having an appropriate flexibility.

Also, the alkoxymethylated nylon which forms the surface layer of the member for charging can maintain always the hygroscopic degree at a constant level against fluctuation in environment to be excellent in environmental stability, particularly substantially without change in volume resistivity under low temperature and low humidity (e.g. 15° C., 10% RH), whereby charging ability is always stable and uniform charging without charging irregularity can be effected.

Further, the surface layer formed of an alkoxymethylated nylon can be made to have a low resistivity of $10^6$ to $10^{12}$ ohm·cm, particularly $10^8$ to $10^{11}$ ohm·cm along with stability of the volume resistivity to fluctuation in environment. The low resistivity of the surface layer is particularly effective for the dielectric breakdown of the member to be charged and the image defect accompanied therewith.

More specifically, when direct charging is to be effected, if a high voltage is applied on a member for charging arranged in contact with a member to be charged, the defective portion internally of the member to be charged undergoes discharging dielectric breakdown. Such member to be charged will be charged nonuniformly, and further excessive current flows from the member for charging to its breakdown point, whereby the voltage applied on the member for charging drops down. As the result, in the case when the member to be charged is an electrophotographic photosensitive member, defective charging occurs over the whole photosensitive member contact region and white band in the case of the normal developing system, while black band in the case of the reversal positive system will appear on the image. For preventing these, it is desirable to make the voltage to be applied lower, and for effecting uniform charging by application of such low voltage, it is necessary to maintain the surface layer of the member for charging at low resistivity.

Also, when high voltage is applied, much products such as ozone or NOx, etc. will be formed during charging, and deleterious influences such as unfocused image, image flow, etc. will be exerted on an electrophotographic photosensitive member, particularly an electrophotographic photosensitive member having a photosensitive layer containing an organic photoconductive member.

In contrast, as the present invention, by forming the surface layer of the member for charging of an alkoxymethylaed nylon to make the volume resistivity $10^6$ to $10^{12}$ ohm·cm, uniform charging at low voltage is rendered possible, whereby image defect can be remarkably improved.

When a member for charging having a surface layer formed of a N-alkoxymethylated nylon is used for many times repeatedly particularly under the environment of high temperature and high humidity, the surface layer may sometimes become highly resistant and lowered in charging ability. In this case, it is preferable to incorporate further electroconductive powder in the surface layer formed of a N-alkoxymethylated nylon. The reason why charging ability of the member for charging is lowered is not clear, but it may be considered that the N-alkoxymethylated nylon has undergone the crosslinking reaction with the heat under high temperature and high humidity environment, or the acid generated from NOx, which is the product of corona discharging slightly formed even by direct charging using the member for charging, and the moisture under high temperature and high humidity environment. Thus, when the member for charging is repeated for many times repeatedly under an atmosphere of heat and acid, the alkoxymethylated nylon may proceed the crosslinking reaction with nylon which is not alkoxymethylated as shown below to have a three-dimensional steric structure:

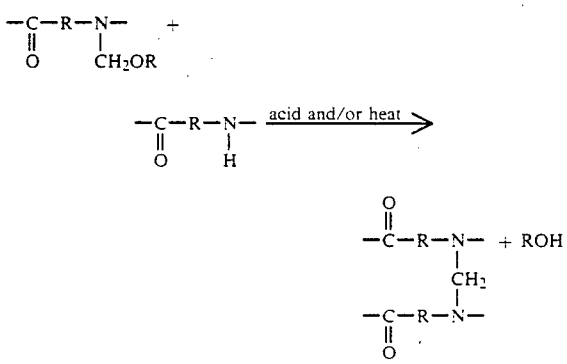

With such a reaction, it may be estimated that the alkoxymethylated nylon becomes highly resistant to be lowered in charging ability.

In contrast, by incorporating electroconductive powder in the alkoxymethylated nylon, lowering in charging ability by increased resistivity of the alkoxymethylated nylon can be prevented. Electroconductive powder can be generally contained by dispersing it in a solution containing the alkoxymethylated nylon dissolved therein. Electroconductive powder in the alkoxymethylated nylon, as different from the form in which electroconductive powder is contained in a chloroprene rubber as in the prior art, is contained uniformly and yet substantially without agglomeration perhaps due to good affinity, and also no influence such as damage, etc. is given to the surface of the contacted member to be charged perhaps because of covering around individual electroconductive powder with the alkoxymethylated nylon.

As electroconductive powder which can be contained in the alkoxymethylated nylon, there may be included, for example, metal oxide powder such as titanium oxide powder, tin oxide powder, etc., metal powder such as aluminum fine powder, etc., non-metallic powder such as carbon powder, fluorinated carbon powder, etc. The content of the electroconductive powder may be preferably 0.1 to 5 parts by weight, particularly 0.3 to 3 parts by weight based on 100 parts by weight of the material for forming the surface layer containing the alkoxymethylated nylon.

In the following, the constitution of the present invention is to be described.

The member for charging of the present invention takes a multi-layer constitution on an electroconductive substrate 2 as shown in FIG. 1, and the shape may be any one of roller, blade, etc.

On a metal core material such as iron, copper, stainless steel as the electroconductive substrate 2, a rubber or an insulating resin subjected to electroconductive treatment by dispersing a metal such as aluminum, copper, etc., an electroconductive polymer such as polyacetylene, polypyrrole, polythiophene, etc. or carbon, etc. therein is formed by dip coating or spray coating as the lower layer 3, and the surface layer 4 as described above is formed on the lower layer 3. The volume resistivity of the lower layer should be desirably lower than that of the surface layer, preferably $10^0$ to $10^{11}$ ohm·cm, particularly $10^2$ to $10^{10}$ ohm·cm. The lower layer 3 may also have a multi-layer constitution. The film thickness of the surface layer should be preferably 5 to 200 μm, preferably 20 to 150 μm.

The alkoxymethylation degree in the surface layer (the substitution ratio of alkoxymethyl group to the total amide bonds in nylon) should be preferably 18% or more with respect to solubility in solvent, flexibility, adhesiveness with the lower layer, film forming property, resistivity controllability.

The alkoxymethylation degree is measured by use of, for example, the Viebock-Schwappach method (Berichte der Deutschen Chemischen Gesellschaft, 63, 2318 (1930)) as shown below.

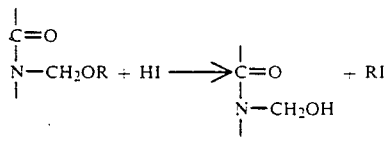

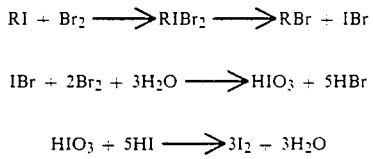

As shown in the above schemes, alkoxyl groups are readily decomposed to form alkyl iodide when heated together with hydroiodic acid. The alkyl iodide formed is absorbed by a mixture of sodium acetate and acetic acid containing minute amount of bromine to become ethyl bromide and iodine bromide. The latter is further oxidized into iodic acid and hydrogen bromide, and superfluous bromine is decomposed with formic acid, and hydrogen bromide after neutralization with sodium acetate is added with potassium iodide, and iodine liberated is titrated with a sodium thiosulfate solution.

The alkoxymethylation degree is measured as described above.

Figure 2:
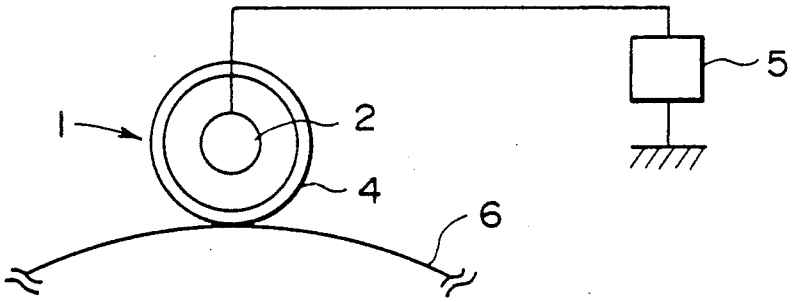
FIG. 2 is a schematic illustration of effecting charging onto a member to be charged with the use of the member for charging.

When charging is effected on a member to be charged by use of the member for charging of the present invention, the member to be charged 6 arranged in contact with the member for charging 1 is charged by the voltage applied from an external power source 5 connected to the member for charging 1 as shown in FIG. 2.

To the voltage to be applied on the member for charging of the present invention, a low voltage direct current voltage, a direct current overlapped with an alternating current voltage can be applied, but according to the investigations by the present inventors, a pulse voltage having a direct current voltage of ±200 V to ±2000 V and an interpeak voltage 4000 V or less overlapped is preferred.

Figure 3:
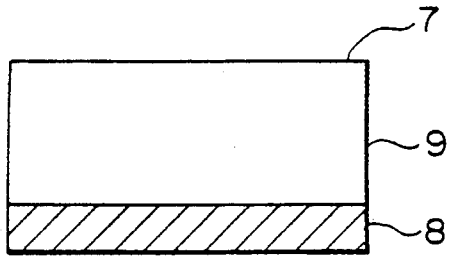
FIG. 3 and FIG. 4 are illustrations showing layer constitutions of electrophotographic photosensitive members.

The member to be charged used in the present invention may include various kinds such as dielectric member, electrophotographic photosensitive member, etc., but an electrophotographic photosensitive member may be constituted as shown in FIG. 3.

The electrophotographic photosensitive member 7 has basically a constitution comprising a photosensitive layer 9 provided on an electroconductive support 8. As the electroconductive support 8, there can be used those of which the support itself has electroconductivity, such as aluminum, aluminum alloy, stainless steel, chromium, titanium, etc., or otherwise the above electroconductive support or plastics having a layer formed by vacuum deposition of aluminum, aluminum alloy, indium oxide-tin oxide alloy, etc., a support having electroconductive particles (e.g. carbon black, tin oxide particles, etc.) coated with a suitable binder into plastic or paper, or plastic having electroconductive binder, etc.

Between the electroconductive support 8 and the photosensitive layer 9, a subbing layer having a barrier function and an adhesive function can be also provided. The subbing layer can be formed of casein, polyvinyl alcohol, nitrocellulose, ethylene-acrylic acid copolymer, polyamide, polyurethane, gelatin, aluminum oxide, etc. The film thickness of the subbing layer may be suitably 5 μm or less, preferably 0.5 to 3 μm. The subbing layer should desirably have a resistivity of $10^7$ ohm·cm or more for exhibiting its function.

Figure 4:
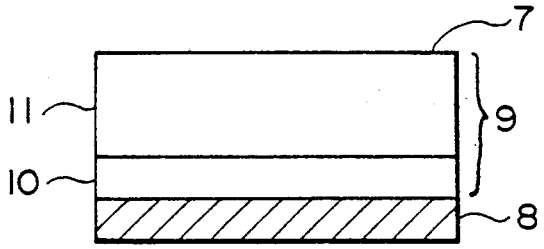

The photosensitive layer 9 may be formed from a photoconductive material such as organic photoconductive material, amorphous silicon, or selenium, by way of coating with a coating material formed optionally together with a binder or by way of vacuum vapor deposition. When an organic photoconductive material is used, a photosensitive layer 9 comprising a laminated structure of a charge generation layer 10 having the ability of generating charged carriers and a charge transport layer 11 having the ability of transporting generated charged carriers as shown in FIG. 4 can be also effectively used.

The charge generation layer 10 can be formed by vapor deposition of one kind or two or more kinds of charge generation materials such as azo pigments, quinone pigments, quinocyanine pigments, perylene pigments, indigo pigments, bisbenzimidazole pigments, phthalocyanine pigments, quinacridone pigments, etc., or by way of coating of a composition of such materials dispersed together with a suitable binder (binder may be also absent).

The binder can be selected from a wide scope of insulting resins or organic photoconductive polymers. For example, insulating resins may include polyvinyl butyral, polyarylate (polycondensate of bisphenol A with phthalic acid, etc.), polycarbonate, polyester, phenoxy resin, acrylic resin, polyacrylamide resin, polyamide, cellulosic resin, urethane resin, epoxy resin, casein, polyvinyl alcohol, etc. Also, as the organic photoconductive polymer, carbazole, polyvinylanthracene, polyvinylpyrene, etc. may be included.

The film thickness of the charge generation layer may be 0.01 to 15 μm, preferably 0.05 to 5 μm, and the weight ratio of the charge generation layer to the binder may be 10:1 to 1:20.

The solvent to be used in the coating material for charge generation layer may be selected depending on the resin employed, solubility of the charge transport material or dispersion stability, but as the organic solvent, alcohols, sulfoxides, ethers, esters, aliphatic halogenated hydrocarbons or aromatic compounds, etc. can be used.

Coating can be practiced by use of dip coating, spray coating, Meyer bar coating, blade coating, etc.

The charge transport layer 11 is formed by dissolving a charge transport material in a resin having film forming property. Examples of the organic charge transport material to be used in the present invention may include hydrazone compounds, stilbene compounds, pyrazoline compounds, oxazole compounds, thiazole compounds, triarylmethane compounds, etc. These charge transport substances can be used as one kind or as a mixture of two or more kinds.

Examples of the binder to be used in the charge transport layer may include phenoxy resin, polyacrylamide, polyvinyl butyral, polyarylate, polysulfone, polyamide, acrylic resin, acrylonitrile resin, methacrylic resin, vinyl chloride resin, vinyl acetate resin, phenol resin, epoxy resin, polyester, alkyd resin, polycarbonate resin, polyurethane or copolymers two or more recurring units of these resin, such as styrene-butadiene copolymer, styrene-acrylonitrile copolymer, styrene-maleic acid copolymer, etc. Also, it can be selected from organic photoconductive polymers such as poly-N-vinylcarbazole, polyvinylanthracene, polyvinylpyrene, etc.

The film thickness of the charge transport layer may be 5 to 50 μm, preferably 8 to 20 μm, and the weight ratio of the charge transport substance to the binder may be 5:1 to 1:5, preferably 3:1 to 1:3. Coating can be practiced according to the coating methods as mentioned above.

Further, since dyes, pigments, organic charge transport substances, etc. are generally weak to UV-ray, ozone, contamination with oils, metals, etc., a protective layer may be also provided, if necessary. For forming an electrostatic latent image on the protective layer, the surface resistance should be preferably $10^{11}$ ohm or higher.

The protective layer which can be used in the present invention can be formed by coating and drying a solution of a resin such as polyvinyl butyral, polyester, polycarbonate, acrylic resin, methacrylic resin, nylon, polyimide, polyarylate, polyurethane, styrene-butadiene copolymer, styrene-acrylic acid copolymer, styrene-acrylonitrile copolymer, etc. dissolved in a suitable solvent on a photosensitive layer. In this case, the film thickness of the protective layer may be generally within the range of 0.05 to 20 μm. In the protective layer, an additive such as UV-ray absorber may be also contained.

Figure 5:
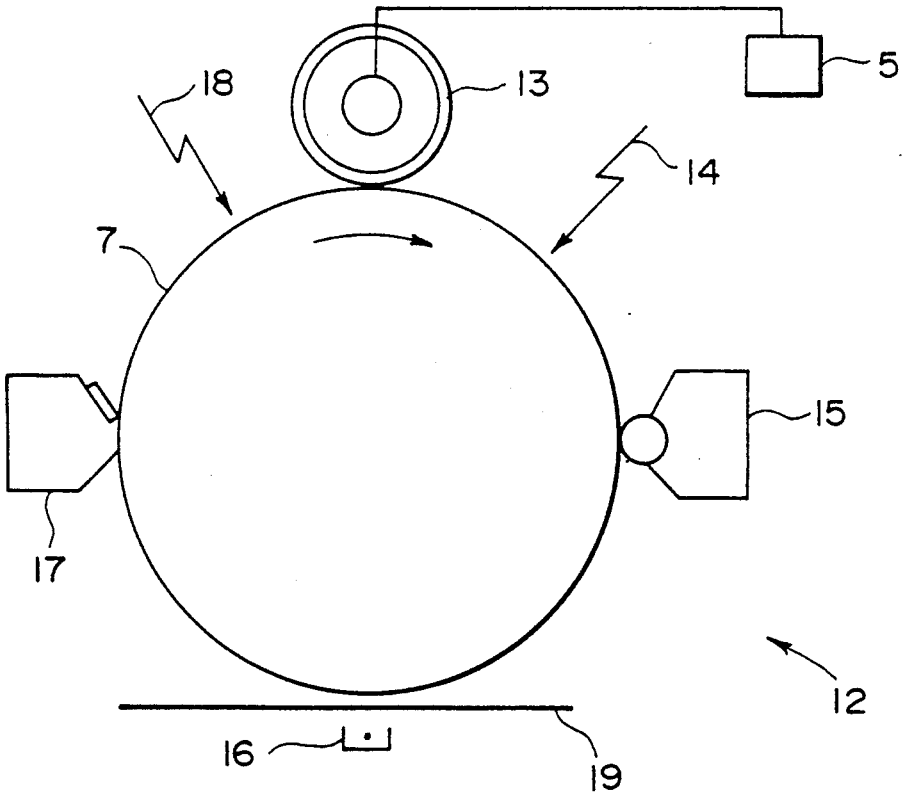
FIG. 5 is a schematic illustration of an electrophotographic device by use of the member for charging.

The member for charging of the present invention is applicable to an electrophotographic device 12 as shown in FIG. 5. This device has a primary charging roller 13 which the member for charging, an image-exposure means 14, a developing mens 15, a transfer charging means 16, a cleaning means 17, a pre-exposure means 18 arranged on the peripheral surface of an electrophotographic photosensitive member 7.

On the primary charging roller 13 arranged in contact on the electrophotographic photosensitive member 7 is applied a voltage (e.g. a pulse voltage having a direct current voltage of 200 V to 2000 V and an alternating current voltage wherein the interpeak voltage has 4000 V overlapped) from an external power source 5 to charge the surface of the electrophotographic photosensitive member 7, and the image on an original manuscript is exposed imagewise onto the photosensitive member by means of the exposure means 14 to form an electrostatic latent image. Next, by attaching the developing agent in the developing means 15 onto the photosensitive member, the electrostatic latent image on the photosensitive member is developed (visualized), and further the developing agent on the photosensitive member is transferred by means of the transfer charging means 16 onto the image-receiving member 19 such as paper and so forth, and the developing agent, remaining on the photosensitive member without transfer on the paper during transfer is recovered with the cleaning means 17.

The image can be formed by such electrophotographic process, but when residual charges remain on the photosensitive member, it is preferable to deelectrify the residual charges by irradiating light on the photosensitive member by the pre-exposure means 18 prior to effecting primary charging.

As the light source for the image exposure means 14, halogen light, fluorescent lamp light, laser beam, LED, etc. can be employed.

As the developing means 15, there may included the devices to be used for the two-component developing method, the one-component developing method by use of magnetic toner, the one-component developing method by use of non-magnetic toner, etc. Also, the developing system may be either the normal developing system, or the reversal developing system.

The member for charging of the present invention can exhibit its characteristics remarkably by applying it to an electrophotographic photosensitive member having a photosensitive layer containing an organic photoconductive material which is susceptible to deterioration with respect to mechanical strength, chemical stability.

The arrangement of the member for charging to be contacted with the photosensitive member in the present invention is not limited to a specific method, but any system of the fixed system, or the moving system such as rotation in the same direction as or the opposite direction to the photosensitive member can be employed. Further, the member for charging can be also permitted to function as the developing agent cleaning device on the photosensitive member.

Concerning the application voltage, application method on the member for charging in direct charging of the present invention, although depending on the specifications of the respective electrophotographic devices, other than the system in which the desired voltage is momentarily applied, there can be adopted the system in which the applied voltage is increased stepwise for the purpose of protecting the photosensitive member, or in the case of application having a direct current and an alternating current overlapped, the system in which the voltage is applied in the order of direct current →alternating current, or alternating current→direct current.

Also, in the present invention, for the processes such as image exposure, developing, cleaning, etc., any desired known method in the field of electrostatic photography can be employed, and the kinds of the developing agents are not limited to specific ones. The electrophotographic device by use of the member for charging of the present invention is useful not only for copying machines, but also for electrophotographic application fields such as laser printer, CRT printer, electrophotographic system, printing system, etc.

EXAMPLE 1

A mixture of 100 parts by weight of a chloroprene rubber and 5 parts by weight of electroconductive carbon were melted and kneaded, and molded to 20 mm×300 mm with a stainless steel shaft passed at the center to provide a base layer of a primary charging roller. The volume resistivity of the primary charging roller base layer was measured under the environment of a temperature of 22° C. and a humidity of 60% to be $3\times10^4$ ohm·cm. Next, a solution of 10 parts by weight of N-ethoxymethylated nylon-6 (ethoxymethylation degree 20%) dissolved in 90 parts by weight of methanol was coated by dipping on the primary charging roller base layer to a film thickness after drying of 200 μm, thereby providing a primary charging roller surface layer. For measurement of the resistivity of the surface layer of the N-ethoxymethylated nylon-6, a surface layer was provided on a aluminum sheet in the same manner, and its volume resistivity was measured.

As described above, a roller for primary charging was prepared as the member for charging.

Next, an electrophotographic photosensitive member was prepared as described below.

First, as an electroconductive support, an aluminum cylinder of 60 mm×260 mm with a thickness of 0.5 mm was prepared.

A solution of 4 parts by weight of a copolymerized nylon (trade name: CM8000, manufactured by Toray Industries, Inc.) and 4 parts by weight of a type 8 nylon (trade name: Luckamide 5003, manufactured by Dainippon Ink & Chemicals, Inc.) dissolved in 50 parts by weight of methanol and 50 parts by weight of n-butanol was coated by dipping on the above electroconductive support to form a polyamide subbing layer with a thickness of 0.6 μm.

Ten (10) parts of a disazo pigment of the formula:

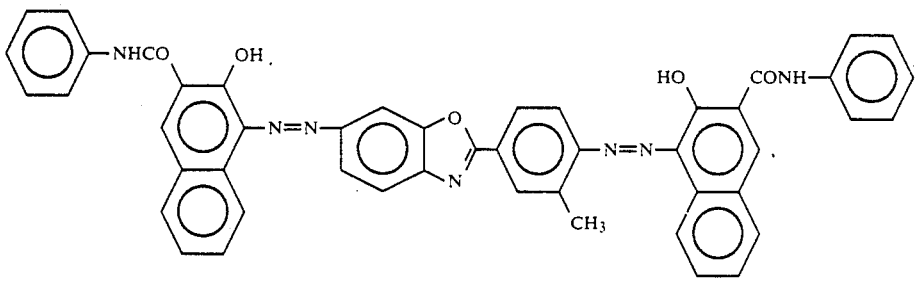

and 10 parts by weight of a polyvinyl butyral resin (trade name: S-LEC BM2, manufactured by Sekisui Chemical Co., Ltd.) were dispersed together with 120 parts by weight of cyclohexanone by a sand mill device for 10 hours. To the resultant dispersion were added 30 parts by weight of methyl ethyl ketone, and the mixture was coated on the above subbing layer to form a charge generation layer with a thickness of 0.15 μm.

Ten (10) parts by weight of a polycarbonate Z resin (manufactured by Mitsubishi Gas Chemical Company, Inc.) with a weight average molecular weight of 120,000 were prepared and dissolved together with 10 parts by weight of a hydrazone compound of the formula:

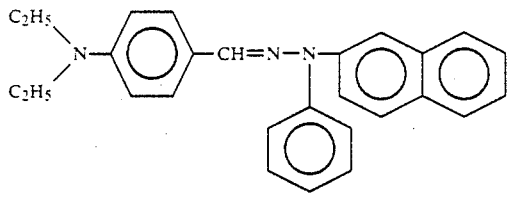

in 80 parts by weight of monochlorobenzene. The resultant solution was coated on the above charge generation layer to form a charge transport layer with a thickness of 16 μm, thus preparing an electrophotographic photosensitive member No. 1.

Next, the above primary charging roller was mounted in a copying machine of the positive developing system (PC-20, manufactured by Canon) having a primary charger, an image exposure by halogen light, one component system developer, a transfer charger and clearner by blade, in place of a primary corona charger thereof, and arranged in contact to the same constitution as in FIG. 5. As the photosensitive member, the above electrophotographic photosensitive member No. 1 was used. Primary charging was effected by applying a pulse voltage having direct current voltage −750 V and an alternate interpeak current voltage 1500 V overlapped, and potential measurement at the dark portion potential and the light portion potential, and the image when a pinhole of 1 mm was opened on the photosensitive member under normal temperature and normal humidity of a temperature of 22° C. and a humidity of 60%, were investigated. The results are shown in Table 1.

Further, volume resistivity of the surface layer of the primary charging roller, potential characteristics and the image when the primary charging roller was mounted on the positive developing system copying machine under the low temperature and low humidity state of 15° C. and 10% RH were similarly investigated to obtain the results shown in Table 1.

EXAMPLE 2

A primary roller base layer was prepared in the same manner as in Example 1, and a solution of 10 parts by weight of a N-methoxymethylated nylon-6 (methoxymethylation degree 30%) dissolved in 90 parts by weight of methanol was coated by dipping to a film thickness after drying of 200 μm, to provide a primary charging roller surface layer.

The primary charging roller thus prepared was evaluated similarly as in Example 1 to obtain the results shown in Table 1.

EXAMPLE 3

A primary roller base layer was prepared in the same manner as in Example 1, and a solution of 7 parts by weight of a N-methoxymethylated nylon-6 (methoxymethylation degree 30) and 3 parts by weight of a nylon 6-66-610-12 dissolved in 90 parts by weight of methanol was coated by dipping to a film thickness after drying of 200 μm, to provide a primary charging roller surface layer.

The primary charging roller thus prepared was evaluated similarly as in Example 1 to obtain the results shown in Table 1.

COMPARATIVE EXAMPLE 1

A primary roller base layer was prepared in the same manner as in Example 1, and a solution of 10 parts by weight of a nylon 6-66-11 dissolved in 90 parts by weight of methanol was coated by dipping to a film thickness after drying of 200 μm, to provide a primary charging roller surface layer.

The primary charging roller thus prepared was evaluated similarly as in Example 1 to obtain the results shown in Table 1.

COMPARATIVE EXAMPLE 2

A primary roller base layer was prepared in the same manner as in Example 1, and a solution of 10 parts by weight of a nylon 6-66-610-12 dissolved in 90 parts by weight of methanol was coated by dipping to a film thickness after drying of 200 μm, to provide a primary charging roller surface layer.

The primary charging roller thus prepared was evaluated similarly as in Example 1 to obtain the results shown in Table 1.

COMPARATIVE EXAMPLE 3

The primary charging roller base layer of Example 1 was mounted as such in place of the primary corona charger of the above copying machine, and the electrophotographic photosensitive member No. 1 was used as the photosensitive member.

The primary charging roller thus prepared was evaluated similarly as in Example 1 to obtain the results shown in Table 1.

COMPARATIVE EXAMPLE 4

In the same manner as in Example 1, a primary charging roller base layer was prepared, and 10 parts by weight of a chloroprene rubber, 0.2 part by weight of electroconductive carbon and 90 parts by weight of methyl ethyl ketone were added and dispersed in a ball mill. The dispersion was coated by dipping on the primary charging roller base layer to a film thickness after drying of 200 μm, to provide a primary charging roller surface layer.

The primary charging roller thus prepared was evaluated similarly as in Example 1 to obtain the results shown in Table 1.

COMPARATIVE EXAMPLE 5

In the same manner as in Example 1, a primary charging roller base layer was prepared, 10 parts by weight of a nylon-6 were dissolved in 90 parts by weight of dimethylformamide, and the resultant solution was coated by dipping on the primary charging roller base layer to a film thickness after drying of 200 μm to provide a primary charging roller surface layer.

The primary charging roller thus prepared was evaluated similarly as in Example 1 to obtain the results shown in Table 1.

COMPARATIVE EXAMPLE 6

In the same manner as in Example 1, a primary charging roller base layer was prepared. 5 parts by weight of a polyether polyol and 5 parts by weight of toluylene diisocyanate were dissolved in methyl ethyl ketone, and the resultant solution was coated by dipping on the primary charging roller base layer to a film thickness after drying of 200 μm to provide a primary charging roller surface layer of polyurethane.

The primary charging roller thus prepared was evaluated similarly as in Example 1 to obtain the results shown in Table 1.

TABLE 1

| | Surface layer material | Volume resistivity of surface layer (Ω · cm) | Dark portion potential (−V) | Light portion potential (−V) | Image density* (Initial 10 copies) | Image defect (initial 10 copies) | Leak by pinhole | Sucessive copying image defect (streaks caused by damage) |
|---|---|---|---|---|---|---|---|---|
| Example 1 | N-ethoxy-methylated nylon-6 | $7 \times 10^{10}$ | 700 | 110 | ○ | none | none | normal after 4000 copies |
| | | $2 \times 10^{11}$ | 700 | 130 | ○ | " | " | normal after 4000 copies |
| Example 2 | N-methoxy-methylated nylon-6 | $5 \times 10^{9}$ | 690 | 120 | ○ | none | none | normal after 4000 copies |
| | | $8 \times 10^{10}$ | 680 | 140 | ○ | " | " | normal after 4000 copies |
| Example 3 | N-ethoxy-methylated nylon-6/ nylon 6-66-610-12 | $5 \times 10^{10}$ | 690 | 115 | ○ | none | none | normal after 4000 copies |
| | | $7 \times 10^{11}$ | 690 | 110 | ○ | " | " | normal after 4000 copies |
| Comparative example 1 | Nylon 6-66-11 | $6 \times 10^{10}$ | 695 | 110 | ○ | none | none | generated after 2900 copies |
| | | $9 \times 10^{13}$ | 480 | 110 | x | white spot generated | " | generated after 2700 copies |
| Comparative example 2 | Nylon 6-66-610-12 | $9 \times 10^{9}$ | 700 | 105 | ○ | none | none | generated after 3000 copies |
| | | $2 \times 10^{13}$ | 430 | 100 | x | white spot generated | " | generated after 2700 copies |
| Comparative example 3 | Carbon dispersed chloroprene | $3 \times 10^{4}$ | 700 | 120 | ○ | many white spots | lateral white band generated | generated after 900 copies |
| | | $5 \times 10^{5}$ | 690 | 120 | ○ | " | lateral white band generated | generated after 700 copies |
| Comparative example 4 | Carbon dispersed chloroprene | $4 \times 10^{9}$ | 450 | 50 | x | many white spots | none | generated after 1800 copies |
| | | $2 \times 10^{10}$ | 410 | 60 | x | " | " | generated after 1400 copies |
| Comparative example 5 | Nylon-6 | $8 \times 10^{13}$ | 400 | 50 | x | many white spots | none | generated after 2100 copies |
| | | $9 \times 10^{16}$ | 380 | 80 | x | " | " | generated after 1800 copies |
| Comparative example 6 | Polyurethane | $9 \times 10^{13}$ | 390 | 45 | x | many white spots | none | normal after 4000 copies |
| | | $3 \times 10^{16}$ | 360 | 75 | x | " | " | normal after 4000 copies |

*Image density is expressed as ○, when reproduction of 1 or more is possible in copying of solid black manuscript of 1.3 by Macbeth densitometer, and x when it is less than 1.

In Examples and Comparative examples, the upper column shows measurement under normal temperature and normal pressure (22° C., 60% RH) and the lower column under low temperature and low humidity (15° C., 10% RH).

As is apparent from the above results, by use of the member for charging of the present invention as shown in Examples 1 to 3, no damage is attached and no image defect such as black streak cause by such damage will be generated. Also, since the volume resistivity does not change according to fluctuation in environmental conditions, both dark portion potential and light portion potential are stable, and also image density is good.

On the other hand, the members for charging as in Comparative examples 1 and 2, give damages to the photosensitive surface, whereby black streaks are generated. Further, the volume resistivity changes according to fluctuation in environmental conditions, whereby image density is lowered to give rise to image defect. Also, the member for charging as in Comparative examples 5 and 6 are poor in environmental stability, having high volume resistivity of $10^{13}$ ohm.cm even under normal environment, and therefore cannot be uniformly charged with low charging ability under the charging conditions by overlapping of a direct current voltage of −750 V and an alternating current interpeak voltage 1500 V, whereby the image density is low and also white dots are generated.

Further, the members for charging as in Comparative examples 3 and 4 have carbon precipitated on the surface, whereby the photosensitive member is liable to be damaged to generate image defects. In the member for charging as in Comparative example 3, the charging potential is normal, but white band in the lateral direction due to pinhole is seen. In Comparative example 4, due to carbon dispersion of low resistance in chloroprene of high resistance, there are high resistance portions and low resistance portions as microscopically observed, whereby there are much white dots on the image due to charging irregularity.

EXAMPLE 4

An aluminum cylinder was prepared in the same manner as in Example 1 and coated with a polyamide subbing layer.

Next, 20 parts by weight of an ε-copper phthalocyanine (manufactured by Toyo Ink Mfg. Co., Ltd.), 10 parts by weight of a polyvinyl butyral (S-LEC BL-S, manufactured by Sekisui Chemical Co., Ltd.) and 70 parts by weight of methyl ethyl ketone were dispersed in a sand mill to obtain a coating material for charge generation layer after dispersing. The coating material for charge generation layer was coated by dipping on the previous subbing layer to a film thickness of 0.20 μm. Further, a charge generation was coated similarly as in Example 1 to prepare an electrophotographic photosensitive member No. 2.

Next, 10 parts of an ethoxymethylated nylon-12 (ethoxymethylation degree 20%) was dissolved in 90 parts by weight of methanol, and the resultant solution was coated by dipping on a primary charging roller base layer to a film thickness of after drying of 180 μm, to provide a primary charging roller surface layer. For measurement of the resistivity of the surface layer, the same surface layer was provided on an aluminum sheet and its volume resistivity was measured.

The primary charging roller was mounted in place of the primary corona charger as of the reverse development system laser printer (LBP-8 manufactured by Canon), and contact arranged to the same constitution as shown in FIG. 5. As the photosensitive member, the photosensitive member No. 2 was used. Primary charging was effected by applying a pulse voltage having a direct current voltage −750 V and an alternating current interpeak voltage 1500 V overlapped, and potential measurement of the dark portion potential and the light portion potential and the image when a pinhole of 1 mm was opened on the photosensitive member were examined under normal temperature and normal humidity of a temperature of 22° C. and a humidity of 60%.

Further, the volume resistivity of the surface layer of the primary charging roller, and the potential characteristics and the image when the primary charging roller was mounted on the above laser printer were investigated under the low temperature and low humidity state of 15° C. and 10% RH, to obtain the results shown in Table 2.

EXAMPLE 5

A primary charging roller base layer was prepared in the same manner as in Example 1, 10 parts by weight of a methoxymethylated nylon-12 (methoxymethylation degree 30%) were dissolved in 90 parts by weight of methanol, and the resultant solution was coated by dipping on the primary charging roller base layer to a film thickness after drying of 80 μm to provide a primary charging roller surface layer.

The primary charging roller thus prepared was evaluated similarly as in Example 4 to obtain the results shown in Table 2.

COMPARATIVE EXAMPLE 7

A primary charging roller base layer was prepared in the same manner as in Example 1, 10 parts by weight of a nylon-6-66-11 were dissolved in 90 parts by weight of methanol, and the resultant solution was coated by dipping on the primary charging roller base layer to a film thickness after drying of 80 μm to provide a primary charging roller surface layer.

The primary charging roller thus prepared was evaluated similarly as in Example 4 to obtain the results shown in Table 2.

COMPARATIVE EXAMPLE 8

A primary charging roller base layer was prepared in the same manner as in Example 1, 10 parts by weight of a nylon-6-66-610-12 were dissolved in 90 parts by weight of methanol, and the resultant solution was coated by dipping on the primary charging roller base layer to a film thickness after drying of 80 μm to provide a primary charging roller surface layer.

The primary charging roller thus prepared was evaluated similarly as in Example 4 to obtain the results shown in Table 2.

COMPARATIVE EXAMPLE 9

The primary charging roller base roller of Example 1 was mounted as such in place of the primary corona charger of the reversal development system laser printer, and the electrophotographic photosensitive member No. 2 was used as the photosensitive member.

The primary charging roller thus prepared was evaluated similarly as in Example 4 to obtain the results shown in Table 2.

COMPARATIVE EXAMPLE 10

A primary charging roller base layer was prepared in the same manner as in Example 1. Next, 10 parts by weight of a chloroprene rubber, 0.2 part by weight of electroconductive carbon and 90 parts by weight of methyl ethyl ketone were added and dispersed in a ball mill. The dispersion was coated by dipping on the primary charging roller base layer to a film thickness after drying of 80 μm to provide a primary charging roller surface layer.

The primary charging roller thus prepared was evaluated similarly as in Example 4 to obtain the results shown in Table 2.

COMPARATIVE EXAMPLE 11

A primary charging roller primary layer was prepared in the same manner as in Example 1, 10 parts by weight of a nylon-6 were dissolved in 90 parts by weight of dimethylformamide, and the resultant solution was coated by dipping on the primary charging roller base layer to a film thickness after drying of 80 μm to provide a primary charging roller surface layer.

The primary charging roller thus prepared was evaluated similarly as in Example 4 to obtain the results shown in Table 2.

TABLE 2

| | Surface layer material | Volume resistivity of surface layer (Ω · cm) | Dark portion potential (−V) | Light portion potential (−V) | Image defect (initial 10 copies) | Leak by pinhole | Successive copying image defect (streaks caused by damage) |
|---|---|---|---|---|---|---|---|
| Example 4 | Ethoxymethylated nylon-12 | $5 \times 10^{10}$ | 700 | 160 | none | none | normal after 4000 copies |
| | | $3 \times 10^{11}$ | 690 | 180 | " | " | " |
| Example 5 | Methoxymethylated nylon-12 | $3 \times 10^{9}$ | 690 | 155 | none | none | normal after 4000 copies |
| | | $7 \times 10^{10}$ | 680 | 170 | " | " | " |
| Comparative | Nylon 6-66-11 | $6 \times 10^{10}$ | 705 | 160 | none | none | generated after 3100 copies |

TABLE 2-continued

| | Surface layer material | Volume resistivity of surface layer (Ω · cm) | Dark portion potential (−V) | Light portion potential (−V) | Image defect (initial 10 copies) | Leak by pinhole | Successive copying image defect (streaks caused by damage) |
|---|---|---|---|---|---|---|---|
| example 7 | | $9 \times 10^{13}$ | 600 | 130 | many black spots | " | generated after 2800 copies |
| Comparative | Nylon | $9 \times 10^{9}$ | 710 | 165 | none | none | generated after 3200 copies |
| example 8 | 6-66-610-12 | $2 \times 10^{13}$ | 560 | 125 | many black spots | " | generated after 2900 copies |
| Comparative | Carbon dispersed | $3 \times 10^{4}$ | 700 | 155 | many black spots | laterial black band generated | generated after 800 copies |
| example 9 | Chloroprene | $5 \times 10^{5}$ | 710 | 190 | " | lateral black band generated | generated after 600 copies |
| Comparative | Carbon dispersed | $4 \times 10^{9}$ | 460 | 70 | black fog | none | generated after 1900 copies |
| example 10 | Chloroprene | $2 \times 10^{10}$ | 430 | 100 | " | " | generated after 1600 copies |
| Comparative | Nylon-6 | $8 \times 10^{13}$ | 420 | 80 | many black spots | none | generated after 2000 copies |
| example 11 | | $9 \times 10^{16}$ | 400 | 105 | black fog | " | generated after 1900 copies |

As is apparent from Table 2, also in the laser printer of the reversal development system, good images were obtained similarly as in Examples 1 to 3, with no streak caused by damage being seen and also no black band due to pinhole being seen. There is also little potential change to the environmental changes, and charging is effected uniformly to give good images.

The following Examples illustrate further improvements of the invention previously described.

EXAMPLE 6

A primary charging roller base layer was prepared in the same manner as in Example 1. Next, as electroconductive powder, 0.3 part by weight of carbon powder (RAVEN 1020, manufactured by Columbian) was dispersed together with 10 parts by weight of a N-methoxymethylated nylon-6 (methoxymethylation degree 30%) and 90 parts by weight of methanol in a sand mill for 5 hours. The dispersion was coated by dipping on the above base layer to a film thickness after drying of 100 μm to provide a primary charging roller surface layer.

As described above, a primary charging roller was prepared as the member for charging.

Next, an electrophotographic photosensitive member was prepared as described below.

An aluminum cylinder of the same shape as that prepared in Example 1 was prepared, and a polyamide subbing layer with a thickness of 0.6 μm was formed on the aluminum cylinder according to the same method as in Example 1.

Next, 10 parts of a disazo pigment of the formula:

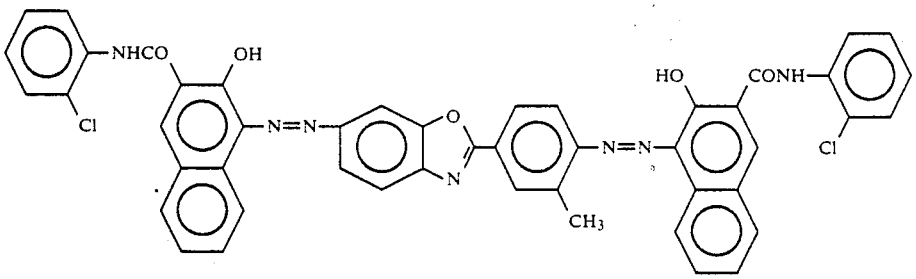

and 10 parts by weight of a polyvinyl butyral resin (trade name: S-LEC BM2, manufactured by Sekisui Chemical Co., Ltd.) were dispersed together with 120 parts by weight of cyclohexanone by a sand mill device for 10 hours. To the resultant dispersion were added 30 parts by weight of methyl ethyl ketone, and the mixture was coated on the above subbing layer to form a charge generation layer with a thickness of 0.15 μm.

Next, 10 parts by weight of a polycarbonate with a weight average molecular weight of 30,000 (Panlite L1250, manufactured by Teijin Limited) and 10 parts by weight of a hydrazone compound of the formula:

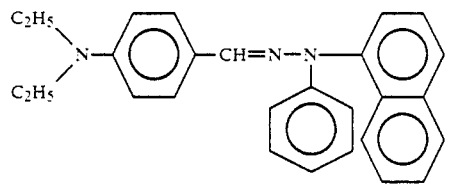

were dissolved in 80 parts by weight of monochlorobenzene. The resultant solution was coated on the above charge generation layer to form a charge transport layer with a thickness of 19 μm, thus preparing an electrophotographic photosensitive member No. 3.

The primary charging roller and the electrophotographic photosensitive member thus prepared were mounted on the positive development system used in Example 1, and the potential characteristic and the successive copying image density were measured and evaluated under the environments of normal temperature and normal humidity (22° C., 60% RH) and high temperature and high humidity (32.5° C., 85% RH) to obtain the results shown in Table 3.

EXAMPLE 7

A primary charging roller base layer was prepared in the same manner as in Example 6. Next, as electroconductive powder, 0.3 part by weight of carbon powder (CONDUCTEX 975 BEADS, manufactured by Columbian) and 0.1 part by weight of titanium oxide type powder (KRONOS ECT-62, manufactured by Titan Kogyo) dispersed together with 10 parts by weight of a N-methoxymethylated nylon-6 (methoxymethylation degree 30%) and 90 parts by weight of methanol in a sand mill for 5 hours. The dispersion was coated by dipping on the above base layer to a film thickness after drying of 200 μm to provide a primary charging roller surface layer.

The primary charging roller thus prepared was mounted on the copying machine used in Example 6, and measured and evaluated in the same manner as in Example 6. The results are shown in Table 3.

EXAMPLE 8

A primary charging roller base layer was prepared in the same manner as in Example 6. Next, as electroconductive powder, 0.3 part by weight of carbon powder (RAVEN 1020, manufactured by Columbian) was dispersed together with 10 parts by weight of a N-ethoxymethylated nylon-6 (ethoxymethylation degree 25%) and 90 parts by weight of methanol in a sand mill for 5 hours. The dispersion was coated by dipping on the above base layer to a film thickness after drying of 150 μm to provide a primary charging roller surface layer.

The primary charging roller thus prepared was mounted on the copying machine used in Example 6, and measured and evaluated in the same manner as in Example 6. The results are shown in Table 3.

REFERENCE EXAMPLE 1

A primary charging roller was prepared in the same manner as in Example 6 except that no carbon powder which is electroconductive powder was incorporated during formation of the primary charging roller surface layer in the primary charging roller of Example 6.

The primary charging roller thus prepared was mounted on the copying machine used in Example 6, and measured and evaluated in the same manner as in Example 6. The results are shown in Table 3.

REFERENCE EXAMPLE 2

The same primary roller as used in Comparative example 1 was prepared.

The primary charging roller thus prepared was mounted on the copying machine used in Example 6, and measured and evaluated in the same manner as in Example 6. The results are shown in Table 3.

TABLE 3

| | Surface layer material | Volume resistivity of surface layer (Ω · cm) | Dark portion potential (−V) | Light portion potential (−V) | Successive copying image density** 6000 copies | 8000 copies | 10000 copies | 12000 copies | 15000 copies |
|---|---|---|---|---|---|---|---|---|---|
| Example 6 | N-methoxymethylated nylon-6 containing carbon powder dispersed therein | $2 \times 10^9$ | 700 | 100 | ○ | ○ | ○ | ○ | ○ |
| | | $8 \times 10^8$ | 700 | 85 | ○ | ○ | ○ | ○ | ○ |
| Example 7 | N-methoxymethylated nylon-6 containing carbon powder and titanium oxide powder dispersed therein | $1 \times 10^9$ | 700 | 95 | ○ | ○ | ○ | ○ | ○ |
| | | $7 \times 10^8$ | 690 | 75 | ○ | ○ | ○ | ○ | ○ |
| Example 8 | N-ethoxymethylated nylon-6 containing carbon powder dispersed therein | $9 \times 10^9$ | 690 | 100 | ○ | ○ | ○ | ○ | ○ |
| | | $1 \times 10^9$ | 680 | 90 | ○ | ○ | ○ | ○ | ○ |
| Reference example 1 | N-methoxymethylated nylon-6 | $5 \times 10^9$ | 700 | 100 | ○ | ○ | ○ | ○ | ○ |
| | | $1 \times 10^9$ | 690 | 80 | ○ | ○ | Δ | Δ | x |
| Reference example 2* | Nylon 6-66-11 | $6 \times 10^{10}$ | 695 | 110 | ○ | ○ | ○ | ○ | ○ |
| | | $3 \times 10^9$ | 690 | 90 | ○ | ○ | ○ | ○ | ○ |

*In Reference example 2, many streaks caused by damage were generated as successive copying was repeated.

**Image density is expressed as ○, when reproduction of 1.1 to 1.3 is possible in copying of solid black manuscript by Macbeth densitometer. Δ when it is 0.9 to 1.1 and x when it is less than 0.9.

In Examples and Reference examples, the upper column is under the environment of normal temperature and normal humidity (22° C., 60% RH) and the lower column under the environment of high temperature and high humidity (32.5° C., 85% RH).

As is apparent from the results in Table 3, the member for charging having the surface layer of an alkoxymethylated nylon containing electroconductive powder as shown in Example 6 to 8 is good without change in successive copying image density even under the high temperature and high humidity environment.

On the other hand, the member for charging having the surface layer of an alkoxymethylated nylon as shown in Reference example 1 has is good without change in successive copying density under the normal temperature and normal humidity environment, but is lowered in image density by gradual lowering in charging ability when successive copying is repeated under the high temperature and high humidity environment. This may be considered to be due to lowering in charging ability because the resistance became higher as the result of the crosslinking reaction of the alkoxymethylated nylon.

Also, although the member for charging of Reference 2 has good successive copying density, but many streaks caused by damages will be generated as successive copying is repeated.

EXAMPLE 9

A primary charging roller base layer was prepared in the same manner as in Example 1. Next, as electroconductive powder, 0.2 part by weight of carbon powder (RAVEN 1020, manufactured by Columbian) and 0.1 part by weight of zinc oxide powder (Zinc White No. 3, manufactured by Sakai Chemical Industry Co., Ltd.) were dispersed together with 10 parts by weight of N-ethoxymethylated nylon-12 (ethoxymethylation degree 20%) and 90 parts by weight of methanol in a sand mill device for 5 hours. The dispersion was coated by dipping on the above base layer to a film thickness after drying of 100 μm to provide a primary charging roller surface layer.

As described above, a primary charging roller was prepared as the member for charging.

Next, an electrophotographic photosensitive member was prepared as described below.

An aluminum cylinder of the same shape as that prepared in Example 1 was prepared, and a polyamide subbing layer with a thickness of 0.6 μm was formed on the aluminum cylinder according to the same method as in Example 1.

Next, 20 parts by weight of a diszao pigment of the following formula:

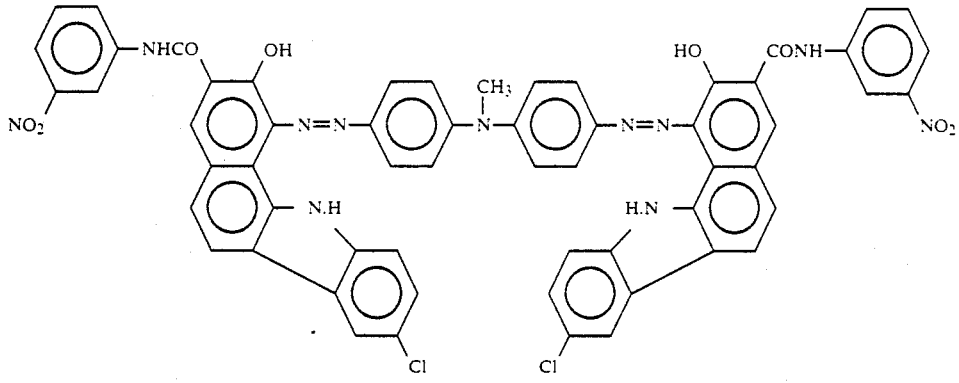

10 parts by weight of a polymethyl methacrylate resin (number average molecular weight $17\times10^4$, manufactured by Seiko Kagaku) and 80 parts by weight of methyl ethyl ketone were dispersed in a sand mill, to obtain a coating material for charge generation layer after dispersing. The coating material for charge generation layer was coated by dipping on the previous subbing layer to a film thickness of 0.15 μm. Further, the charge transport layer was coated in the same manner as in Example 6 to prepare an electrophotographic photosensitive member No. 4.

The primary charging roller and the electrophotographic photosensitive member thus prepared were mounted on the reversal development system laser printer used in Example 4, and the potential characteristic and the successive copying image density were measured and evaluated under normal temperature and normal humidity (22° C., 60% RH) and high temperature and high humidity (32.5° C., 85% RH) environments. The results are shown in Table 4.

EXAMPLE 10

A primary charging roller base layer was prepared in the same manner as in Example 1. Next, as electroconductive powder, 0.5 part by weight of tin oxide type powder (electroconductive powder T-1, manufactured by Mitsubishi Metal Corporation) was dispersed together with 10 parts by weight of a N-methoxymethylated nylon-6 (methoxymethylation degree 30%) and 90 parts by weight of methanol in a sand mill for 4 hours. The dispersion was coated by dipping on the above base layer to a film thickness after drying of 120 μm to provide a primary charging roller surface layer.

The primary charging roller thus prepared was mounted on the laser printer used in Example 9, and measured and evaluated in the same manner as in Example 9. The results are shown in Table 4.

REFERENCE EXAMPLE 3

A primary charging roller was prepared in the same manner as in Example 9 except that no carbon powder and zinc oxide powder which are electroconductive powder was incorporated during formation of the primary charging roller surface layer in the primary charging roller of Example 9.

The primary charging roller thus prepared was mounted on the laser printer used in Example 9, and measured and evaluated in the same manner as in Example 9. The results are shown in Table 4.

TABLE 4

| | Surface layer material | Volume resistivity of surface layer (Ω · cm) | Dark portion potential (−V) | Light portion potential (−V) | Successive copying image density* 6000 copies | 8000 copies | 10000 copies | 12000 copies | 15000 copies |
|---|---|---|---|---|---|---|---|---|---|
| Example 9 | N-ethoxymethylated nylon-12 containing carbon powder and zinc oxide powder dispersed therein | $1\times10^{10}$ | 700 | 120 | ○ | ○ | ○ | ○ | ○ |
| | | $7\times10^{9}$ | 690 | 95 | ○ | ○ | ○ | ○ | ○ |
| Example 10 | N-methoxymethylated nylon-6 containing tin oxide type powder dispersed therein | $9\times10^{8}$ | 700 | 115 | ○ | ○ | ○ | ○ | ○ |
| | | $1\times10^{8}$ | 700 | 90 | ○ | ○ | ○ | ○ | ○ |
| Reference example 3 | N-ethoxymethylated nylon-12 | $5\times10^{10}$ | 700 | 120 | ○ | ○ | ○ | ○ | ○ |
| | | $8\times10^{9}$ | 695 | 100 | ○ | ○ | Δ | x | x |

*Successive copying image density was measured for the fogged state of the white ground portion of the letter image printed out by whiteness meter (TC-6DS: manufactured by Tokyo Denshoku), and expressed as ○ when the ratio of lowering in reflectance is 0 to less than 2%, Δ when 2% to less than 4% and x when 4% or more.

As is apparent from the results in Table 4, the member for charging having a surface layer of an alkoxymethyleted nylon containing electroconductive powder as shown in Examples 9, 10 is good without change in successive copying image density even under the high temperature and high humidity environment.

What is claimed is:

1. A member for contact charging an electrophotographic photosensitive member when said electrophotographic photosensitive member is in contact with said member for charging, said member for contact charging comprising: an electroconductive substrate and a surface layer of N-alkoxymethylated nylon.

2. A member for charging according to claim 1, wherein the member for charging has a multi-layer constitution on an electroconductive substrate.

3. A member for charging according to claim 1, wherein the N-alkoxymethylated nylon has an alkoxymethylation degree of 18% or more.

4. A member for charging according to claim 1, wherein the surface layer has a volume resistivity of $10^6$ to $10^{12}$ ohm.cm.

5. A member for charging according to claim 1, wherein the surface layer has a thickness of 5 to 200 μm.

6. A member for charging according to claim 1, wherein the surface layer contains a polyamide resin.

7. A member for charging according to claim 1, wherein the surface layer contains electroconductive powder.

8. A member for charging according to claim 7, wherein the electroconductive powder is dispersed in the surface layer.

9. A member for charging according to claim 7, wherein the electroconductive powder is carbon powder.

10. A member for charging according to claim 7, wherein 0.1 to 5 parts by weight of electroconductive powder is contained based on 100 parts by weight of the material for formation of the surface layer.

11. A member for charging according to claim 2, wherein the member for charging is shaped in roller.

12. A contact charging method, which performs charging of a member to be charged arranged in contact with a member for charging according to any one of claims 1, 2, 6, 7 and 11 by applying externally a voltage on said member for charging.

13. A contact charging method according to claim 12, wherein the voltage externally applied is a pulse voltage having a direct current voltage of ±200 V to ±2000 V and an alternating current voltage with an interpeak voltage of 4000 V or lower overlapped.

14. An electrophotographic device, comprising a member for charging according to any one of claims 1, 2, 6, 7 and 11 and an electrophotographic photosensitive member arranged in contact with said member for charging.

15. An electrophotographic device according to claim 14, wherein said electrophotographic device has an image exposure means, a developing means, a transfer charging means and a cleaning means on the peripheral surface of said photosensitive member.

16. An electrophotographic device according to claim 14, wherein the electrophotographic photosensitive member is constituted of a photosensitive layer containing an organic photoconductive member on an electroconductive support.

* * * * *